US006093067A

United States Patent [19]

Itoh et al.

[11] Patent Number: 6,093,067

[45] Date of Patent: Jul. 25, 2000

[54] COOLING STRUCTURE FOR OUTBOARD ENGINE

[75] Inventors: Jun Itoh; Shuichi Hagino, both of Hamamatsu, Japan

[73] Assignee: Suzuki Motor Corporation, Hamamatsu, Japan

[21] Appl. No.: 09/479,425

[22] Filed: Jan. 7, 2000

[30] Foreign Application Priority Data

Jan. 8, 1999 [JP] Japan ..... 11-002832

[51] Int. Cl.[7] ..... B63H 21/10

[52] U.S. Cl. ..... 440/88; 123/516; 440/900

[58] Field of Search ..... 440/900, 88; 123/516, 123/198 E, 195 C, 540, 195 P

[56] References Cited

U.S. PATENT DOCUMENTS 5,797,378 8/1998 Kato ..... 123/516

FOREIGN PATENT DOCUMENTS 10218089A 8/1998 Japan .

*Primary Examiner*—Ed Swinehart

*Attorney, Agent, or Firm*—Finnegan, Henderson, Farabow, Garrett & Dunner, L.L.P.

[57] ABSTRACT

A cooling structure for an outboard engine having a cooling water piping of reduced length and simplified construction. In the outboard engine that cools its engine with cooling water to be led from the outside, a water check port is provided in the middle of its cooling water passage. Moreover, a vapor separator is provided on a fuel supply equipment. In addition, a water passage for the water check port is provided so as to branch in the middle of the cooling water passage for a vapor separator. As such, the cooling water is led to the vapor separator and the water check port is located at the inlet of the cooling water before cooling of the engine.

4 Claims, 5 Drawing Sheets

COOLING STRUCTURE FOR OUTBOARD ENGINE

BACKGROUND OF THE INVENTION

1. Field of the Invention

The present invention relates to a cooling structure for an outboard engine.

2. Description of the Related Art

A fuel supply system for an outboard engine is provided with a vapor separator, which separates fuel vapor generated from the liquid fuel, e.g., gasoline, by heat ambient, and releases only the vapor into the atmosphere. Part of engine cooling water is used to cool the vapor separator in order to suppress generation of fuel vapor.

A cooling water system for this type of engine is provided with water checking ports, which are provided on a cooling water passage and which enable checking of engine condition. The water checking ports are in most cases disposed downstream of the engine, so that the cooling water, after cooling the engine, is used to collect water samples downstream of the engine.

In conventional systems, the cooling water passage leading to the vapor separator is separated from a passage for the water check port, so that the piping system is long and complicated. Even more disadvantageously, because the piping system is long and complicated, the piping must be fixed to the engine at several points using clamps, etc., undesirably increasing the number of parts and the number of assembly process steps.

Moreover, when the outlet cooling water after cooling each part of the engine is utilized as the water sample for the purpose of checking, the response to the engine condition is too slow to enable proper monitoring of the engine condition.

SUMMARY OF THE INVENTION

Accordingly, it is an object of the present invention to provide a cooling structure for an outboard engine whose cooling water piping is reduced in length and is simplified in structure.

Another object of the present invention is to provide a cooling structure for an outboard engine which reduces the number of parts and the number of assembly process steps.

Still another object of the present invention is to provide a cooling structure for an outboard engine in which the performance of the vapor separator is improved.

To these ends, according to the present invention, there is provided a cooling system for cooling an outboard engine by cooling water led from the outside, the outboard engine having a cooling water passage with a water check port, and a fuel supply system with a vapor separator, the cooling structure having: a vapor separator cooling water passage leading to the vapor separator; and a water-check water passage branching from the vapor separator cooling water passage and leading to the water check port, wherein inlet cooling water before cooling the engine is supplied to the vapor separator and the water check port.

Preferably, the arrangement is such that the vapor separator cooling water passage has a branching portion at which the water check port water passage branches off the vapor separator cooling water passage, and the vapor separator cooling water passage is fixed at the branching part to the outboard engine.

The cooling structure may further has a one-way valve disposed in a water discharge passage leading from the vapor separator, the one-way valve permitting the cooling water to flow only in normal flowing direction.

The above and other objects, features and advantages of the present invention will become apparent from the following description of a preferred embodiment taken in conjunction with the accompanying drawings.

BRIEF DESCRIPTION OF THE DRAWINGS

The accompanying drawings are included to provide a further understanding of the invention and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Reference will now be made in detail to the present preferred embodiments of the invention illustrated in the accompanying drawings. Wherever possible, the same reference numbers are used throughout the drawings to refer to the same or like parts.

Figure 1:
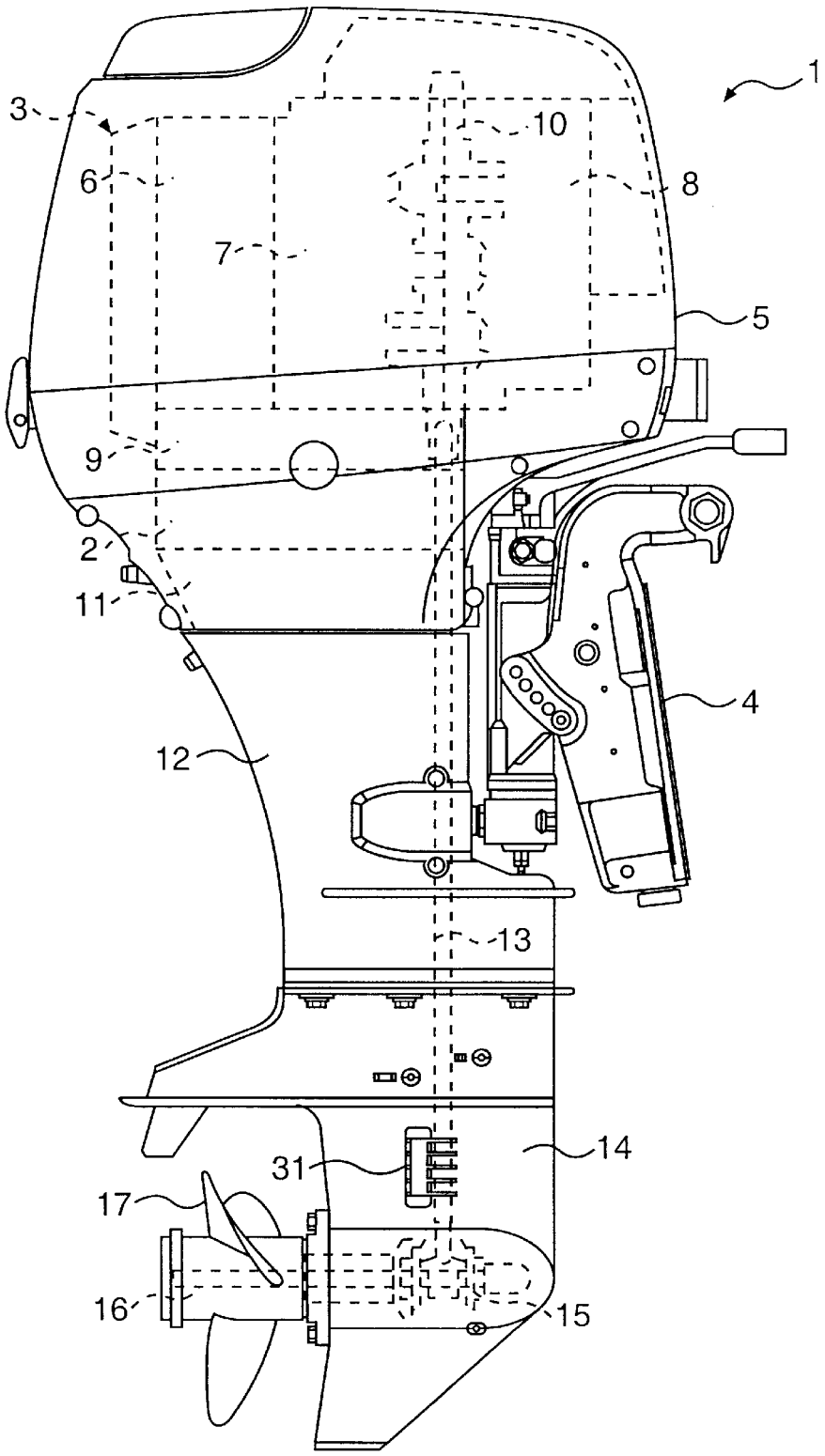
FIG. 1 is a starboard side view of an outboard engine, illustrating a cooling structure according to an embodiment of the present invention.

Referring to FIG. 1, which is a starboard side view of an outboard engine 1 incorporating the present invention, the outboard engine 1 is provided with an engine holder 2, and an engine unit 3 is held by the engine holder 2. The whole outboard engine 1 is mounted on the transom of a hull (not shown in the drawings) via a clamp bracket 4, which is mounted on the engine holder 2. In addition, the periphery of the engine unit 3 is covered with an outboard engine cover 5.

Figure 2:
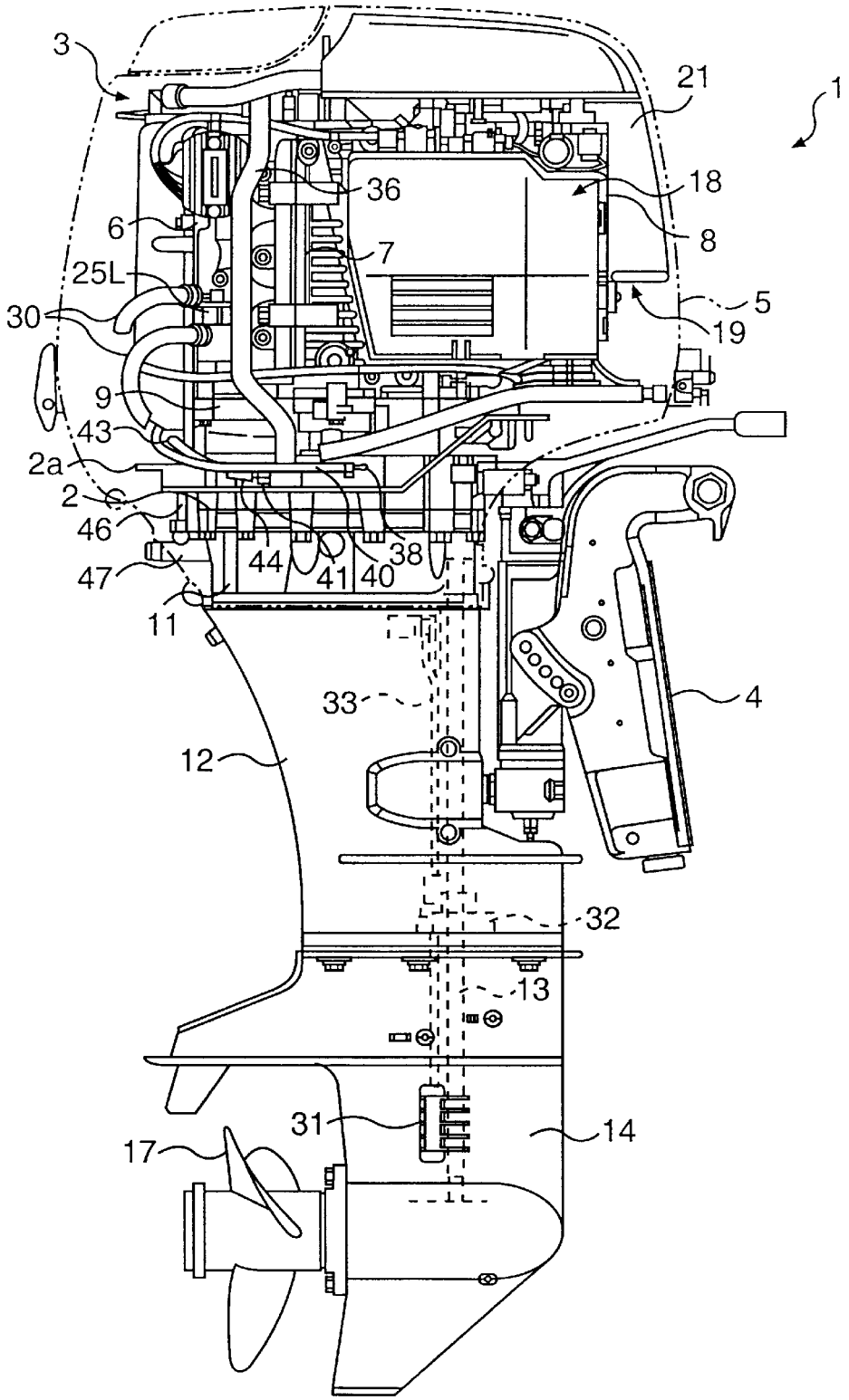
FIG. 2 is a starboard side view of the outboard engine without an outboard engine cover.

FIG. 2 is a starboard side view of the outboard engine 1 without the outboard engine cover 5. As shown in FIGS. 1 and 2, the engine unit 3 mounted on the outboard engine 1 is, for example, a water-cooled, 3-cylinder, 4-cycle engine, and is constituted by engine components including a cylinder head 6, a cylinder block 7, and a crank case 8. The engine unit 3 is installed on the engine holder 2 through, for example, a cam chain case 9.

The crank case 8 is disposed on the front end of the engine unit 3, i.e., on the right-hand end as viewed in FIG. 2. The cylinder block 7 is disposed behind the crank case 8, i.e., on the left side as viewed in FIG. 2. A crank shaft 10 is arranged perpendicularly in a joining part where the crank case 8 and the cylinder block 7 join each other (see FIG. 1). An oil pan 11 is arranged on the lower part of the engine holder 2.

A shaft housing 12 is installed on the lower part of the oil pan 11. The upper end part of a drive shaft 13 is, for example, spline-fitted to the lower end of the crank shaft 10. The drive shaft 13 extends downward through the shaft housing 12 to drive a propeller 17 via a bevel gear 15 and a propeller shaft 16 in a gear case 14 provided on the lower part of the shaft housing 12.

Figure 3:
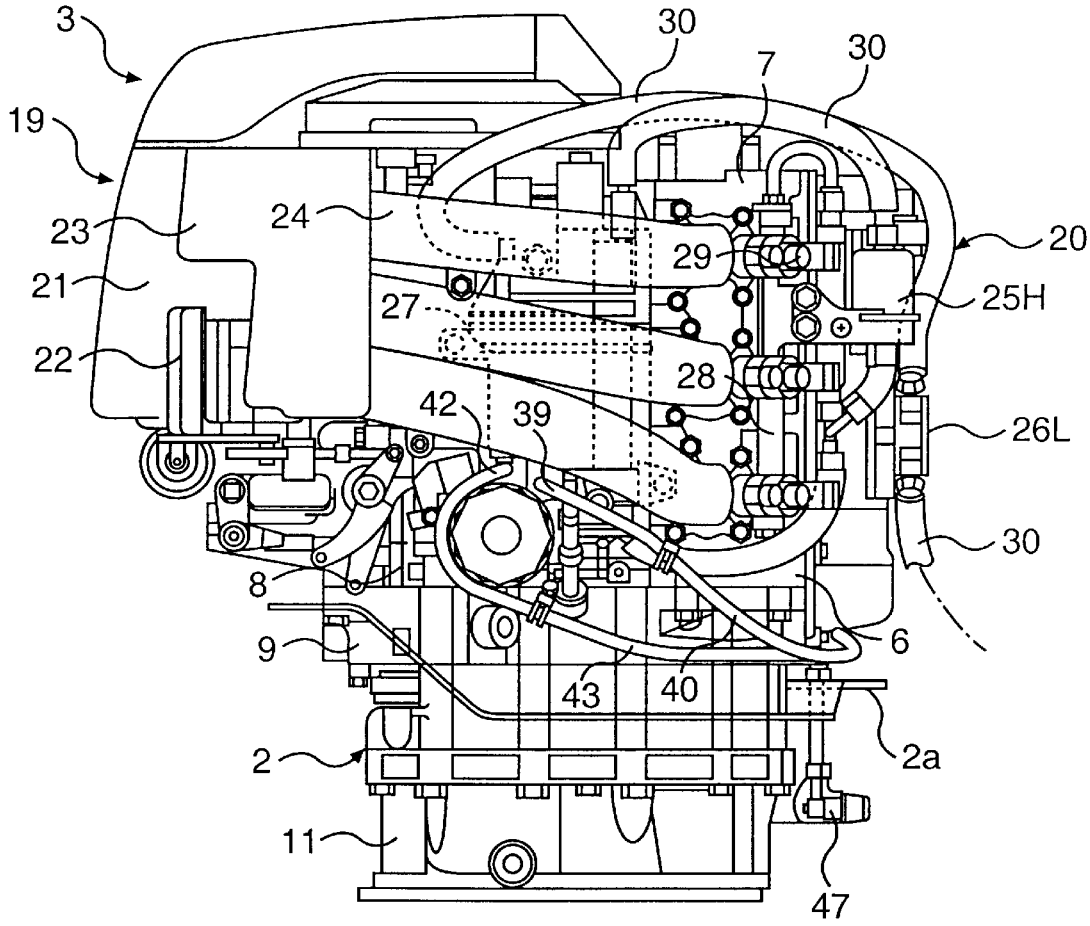
FIG. 3 is a port side view of the engine.
Figure 4:
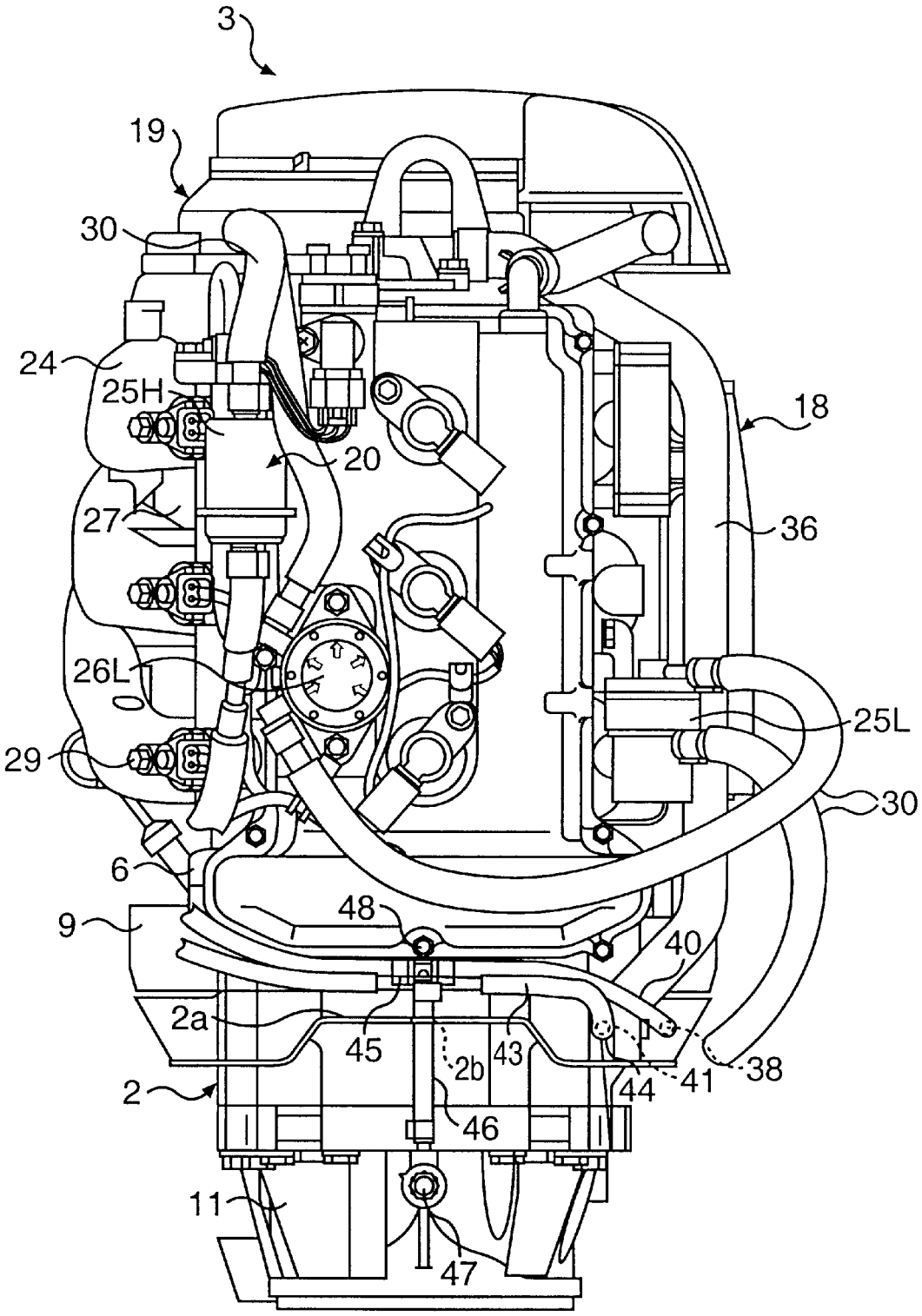
FIG. 4 is a rear elevational view of the engine.

FIG. 3 is a port side view of the engine unit 3. FIG. 4 is a rear elevational view of the engine unit 3. As illustrated in FIG. 2 through FIG. 4, electrical units 18, an air intake system 19, a fuel supply system 20, etc., are arranged around the engine unit 3. The air intake system 19 mainly comprises a silencer 21, a throttle body 22, a surge tank 23, and an air intake manifold 24 extending from the surge tank 23 to each cylinder, and is arranged on one side of the engine unit 3, i.e., on the port side of the engine unit 3 in the illustrated embodiment, in a concentrated manner. The electrical units 18 are arranged on the side of the engine unit 3 opposite to the air intake system 19, i.e., on the right side of the engine in the illustrated embodiment in a concentrated manner.

The air intake manifold 24 is arranged vertically on a side part of the cylinder block 7 to provide communication between each air intake port (not shown in the drawings) formed on the cylinder head 6 and the inside of the surge tank 23.

The fuel supply system 20 has components including a filter and a pump, and more specifically, comprises low-pressure and high-pressure fuel filters 25L and 25H, a low-pressure fuel pump 26L, a high-pressure fuel pump (not shown in the drawings), a vapor separator 27, a pressure regulator (not shown in the drawings), a delivery pipe 28, a fuel injector 29, etc. These components are connected to each other through a fuel hose 30.

A space formed between the left side of the cylinder block 7 and the back side of the air intake manifold 24 accommodates the vapor separator 27. The vapor separator 27 separates the fuel vapor generated in the liquid fuel, for example, gasoline evaporated by ambient heat from the periphery, and releases only the vapor into the atmosphere, while the fuel is led from the low-pressure fuel pump 26L through the fuel hose 30.

The engine unit 3 of the outboard engine 1 is of the water-cooled type, and water drawn from a water intake 31 provided in the gear case 14, for example, sea water, is used as cooling water for cooling the engine unit 3. The cooling water is drawn through a water intake 31 by a water pump 32 driven by the drive shaft 13 as illustrated in FIG. 2, and is led into the engine holder 2 through a water feed pipe 33 and a water passage (not shown in the drawings) in the oil pan 11.

Figure 5:
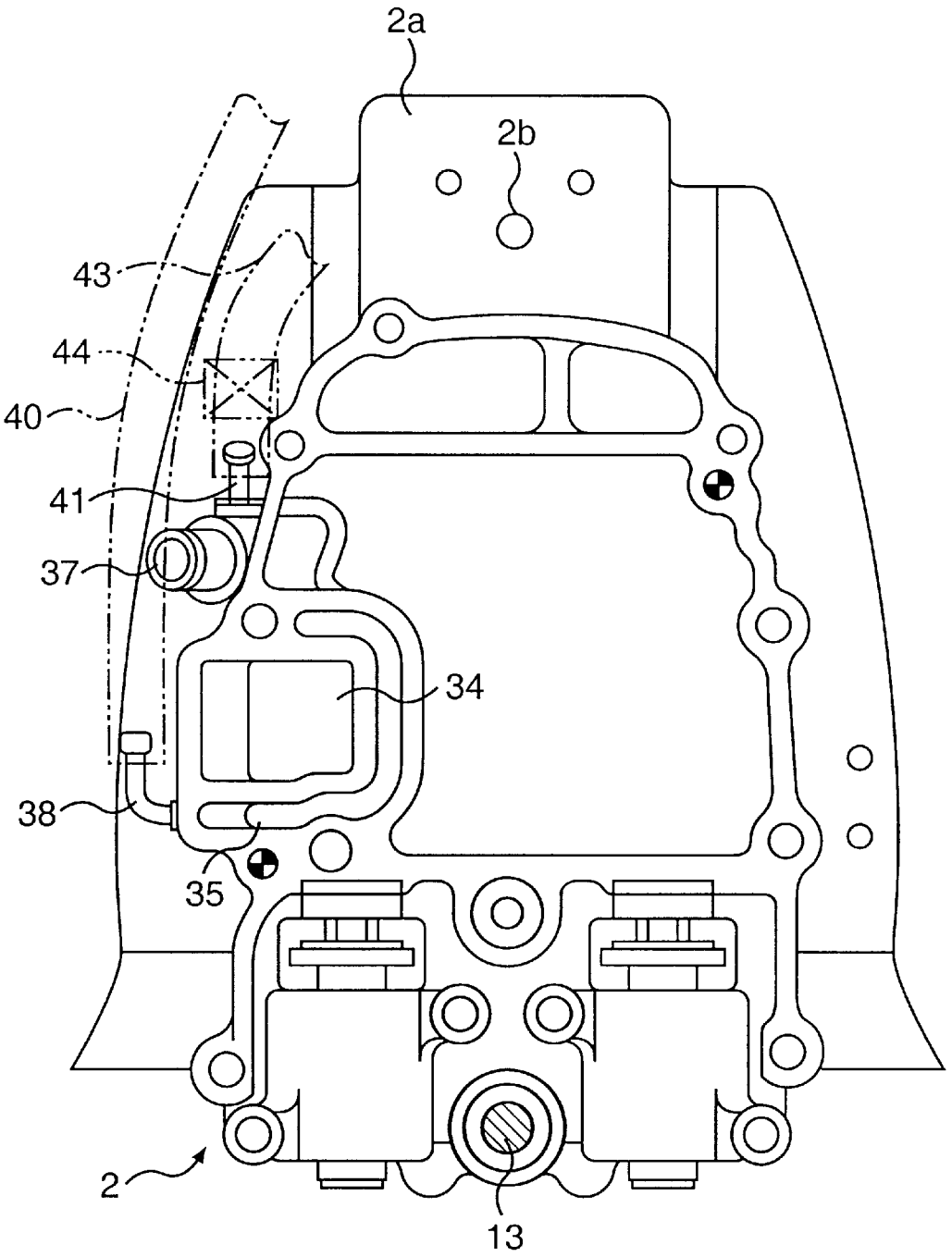
FIG. 5 is a plan view of an engine holder.

FIG. 5 is a plan view of the engine holder 2. AS illustrated in FIG. 5, an exhaust passage 34 is formed to extend through the engine holder 2 to provide communication between the exhaust port (not shown in the drawings) of the engine unit 3 and the shaft housing 12. An inlet cooling water jacket 35 to be connected to the water feed passage in the oil pan 11 is formed around the exhaust passage 34 to cool the exhaust passage 34.

The inlet cooling water jacket 35 is communicated with a water jacket (not shown in the drawings) formed in the cylinder block 7 and the cylinder head 6 to cool each part of the engine unit 3. The cooling water after cooling each part of the engine unit 3 is led to a return water passage 37 (refer to FIG. 5) formed in the engine holder 2 from the upper part of the engine unit 3 through a return hose 36 as illustrated in FIGS. 2 and 4. The cooling water led to the return water passage 37 is mixed with the exhaust gas in the shaft housing 12 and is discharged outside the engine.

An inlet cooling water take-out part 38 connected to the inlet cooling water jacket 35 is provided on the side part of the engine holder 2. A water jacket (not shown in the drawings) is formed on the vapor separator 27, and a cooling water inlet 39 of this water jacket is connected to the inlet cooling water take-out part 38 through a cooling water hose 40 which serves as a vapor-separator cooling water passage for guiding cooling water to the vapor separator.

An outlet cooling water take-out part 41 is provided in the return water passage 37 of the engine holder 2, and a cooling water outlet 42 of the vapor separator water jacket is connected to the outlet cooling water take-in part 41 through an outlet cooling water hose 43 which serves as a water discharge passage from the vapor separator.

When the water pumping pressure of the engine unit 3 is lower than the exhaust pressure, the cooling water in the outlet cooling water hose 43 may undesirably flow in the reverse direction. In order to prevent such a reverse flow, a one-way valve 44, to be opened only for the normal flowing direction of cooling water, is arranged in the middle of the outlet cooling water hose 43.

A T-shaped branching part 45 is provided in the middle of the cooling water hose 40, for example, in the vicinity of the center of the rear surface of the engine unit 3, so as to divide the flow of cooling water into two parts. One part of the flow of the cooling water is led to the vapor separator 27 as described above, while the other is led to a water check port 47 provided in the oil pan 11 through a water check hose 46, which serves as a water-check water passage that guides the cooling water to the water check port.

The branching part 45 is passed through and supported by a support hole 2*b* formed in a fin 2*a* for supporting a packing (not shown in the drawings) provided around the engine holder 2 (refer to FIGS. 4 and 5). The outlet cooling water hose 43 may be supported by the branching part 45.

When the engine unit 3 is in operation, cooling water is taken in from the water intake 31 by the water pump 32 driven by the drive shaft 13, and this inlet cooling water is supplied to each part of the engine unit 3 through the water jacket 35 provided in the engine holder 2.

A part of the cooling water in the inlet cooling water jacket 35 is taken out of the inlet cooling water take-in part 38, and is led to the vapor separator 27 through the cooling water hose 40 to cool the fuel in the vapor separator 27. A part of the cooling water flowing in the cooling water hose 40 is branched at the branching part 45 in the middle, and is led to the water check port 47.

The cooling water after cooling the fuel in the vapor separator 27 is led from the outlet cooling water take-in part 41 to the return water passage 37 of the engine holder 2 through the outlet cooling water hose 43, and is discharged outside the engine together with the cooling water after cooling each part of the engine unit 3.

Thus, the cooling water hose 40 for supplying cooling water to the vapor separator 27 branches at an intermediate portion, i.e., at the branching part 45, so that part of the cooling water is led to the water check port 47. Consequently, the piping is shortened and simplified as compared with conventional systems which require two separate cooling water lines; one leading to the vapor separator 27 and the other leading to the water check port 47.

Further, because the cooling water to be led to the water check port 47 is not the outlet cooling water after cooling each part of the engine unit 3, but is the inlet cooling water, quicker response to engine condition is achieved than that obtained with the use of the outlet cooling water, thus enabling the condition of the engine unit 3 to be monitored more accurately.

It is also to be appreciated that the use of the colder inlet cooling water serves to improve the vapor separation performance of the vapor separator 27.

In addition, the cooling water hose 40 is stably supported only at a single point, i.e., at the branching part 45, by means of, for example, the fin 2*a* of the engine holder 2. This reduces the number of parts, as well as the number of steps of the assembly process.

The one-way valve 44 provided in the outlet water hose 43 opens to permit water to flow only in the normal direction and blocks any backward flow of water which may be caused when the water pumping pressure generated by the engine 3 is exceeded by the exhaust pressure.

As will be understood from the foregoing description, the present invention provides a cooling system for cooling an outboard engine by cooling water led from the outside, the outboard engine having a cooling water passage with a water check port, and a fuel supply system with a vapor separator, the cooling structure comprising: a vapor separator cooling water passage leading to the vapor separator; and a water-check water passage branching from the vapor separator cooling water passage and leading to the water check port, wherein inlet cooling water before cooling the engine is supplied to the vapor separator and the water check port.

The cooling structure serves to shorten and simplify the cooling piping, and permits accurate checking of the engine condition, while improving the vapor separating performance of the vapor separator.

In the described embodiment, the vapor separator cooling water passage has a branching portion at which the water check port water passage branches off the vapor separator cooling water passage, and the vapor separator cooling water passage is fixed at the branching part to the outboard engine. This arrangement reduces the number of parts and the number of steps of the assembly process.

In the described embodiment, a one-way valve is disposed in a water discharge passage leading from the vapor separator, the one-way valve permitting the cooling water to flow only in normal flowing direction. This arrangement prevents reversing flow of water in the vapor separator water discharge passage that may occur when the water pressure is exceeded by the exhaust pressure.

Although the invention has been described in its specific form, it is to be understood that the described embodiment is only illustrative and various changes and modifications may be imparted thereto without departing from the scope of the invention, which is limited solely by the appended claims.

What is claimed is:

1. A cooling system for cooling an outboard engine by cooling water led from the outside, said outboard engine having a cooling water passage with a water check port, and a fuel supply system with a vapor separator, said cooling system comprising:

a vapor separator cooling water passage leading to said vapor separator;

a water-check water passage branching from said vapor separator cooling water passage and leading to said water check port; and wherein inlet cooling water before cooling the engine is supplied to said vapor separator and said water check port.

2. A cooling structure for an outboard engine according to claim 1, wherein said vapor separator cooling water passage has a branching portion at which said water check port water passage branches off said vapor separator cooling water passage, and said vapor separator cooling water passage is fixed at said branching part to said outboard engine.

3. A cooling structure for an outboard engine according to claim 1, further comprising a one-way valve disposed in a water discharge passage leading from said vapor separator so as to open only in a direction of normal flow of the cooling water.

4. A cooling structure for an outboard engine according to claim 2, further comprising a one-way valve disposed in a water discharge passage leading from said vapor separator so as to open only in a direction of normal flow of the cooling water.

* * * * *